US006602838B1

(12) United States Patent
Koester et al.

(10) Patent No.: US 6,602,838 B1
(45) Date of Patent: Aug. 5, 2003

(54) HAND DISHWASHING LIQUID COMPRISING AN ALKOXYLATED CARBOXYLIC ACID ESTER

(75) Inventors: Rita Koester, Duesseldorf (DE); Ansgar Behler, Bottrop (DE); Michael Neuss, Koeln (DE); Karl-Heinz Schmid, Mettmann (DE); Michael Elsner, Solingen (DE)

(73) Assignee: Cognis Deutschland GmbH & Co. KG, Duesseldorf (DE)

( * ) Notice: Subject to any disclaimer, the term of this patent is extended or adjusted under 35 U.S.C. 154(b) by 0 days.

(21) Appl. No.: 09/743,212

(22) PCT Filed: Jun. 26, 1999

(86) PCT No.: PCT/EP99/04453

§ 371 (c)(1),
(2), (4) Date: Mar. 21, 2001

(87) PCT Pub. No.: WO00/02983

PCT Pub. Date: Jan. 20, 2000

(30) Foreign Application Priority Data

Jul. 7, 1998 (DE) ..... 198 30 267

(51) Int. Cl.[7] ..... C11D 1/74; C11D 1/62

(52) U.S. Cl. ..... 510/235; 510/220; 510/289; 510/384; 510/405; 510/421; 510/237

(58) Field of Search ..... 510/220, 235, 510/289, 384, 405, 421, 237, 382, 391

(56) References Cited

U.S. PATENT DOCUMENTS

| | | | | |
|---|---|---|---|---|
| 1,985,424 A | | 12/1934 | Piggott | |
| 2,016,962 A | | 10/1935 | Flint et al. | |
| 2,703,798 A | | 3/1955 | Schwartz | |
| 3,915,867 A | | 10/1975 | Kang et al. | |
| 4,370,272 A | | 1/1983 | Wechsler et al. | |
| 4,767,547 A | | 8/1988 | Straathof et al. | |
| 5,753,606 A | * | 5/1998 | Hees et al. | 510/422 |
| 6,008,392 A | * | 12/1999 | Behler et al. | 554/149 |

FOREIGN PATENT DOCUMENTS

| | | | |
|---|---|---|---|
| DE | 39 14 131 | | 10/1990 |
| DE | 4227046 | * | 2/1993 |
| DE | 4326112 | * | 2/1995 |
| DE | 19611999 | * | 7/1997 |
| EP | 0 239 910 | | 10/1987 |
| EP | 0 293 955 | | 12/1988 |
| EP | 0 295 739 | | 12/1988 |
| EP | 0 309 052 | | 3/1989 |
| JP | 9078092 | * | 3/1997 |
| WO | WO 92/06984 | | 4/1992 |
| WO | WO 94/13618 | | 6/1994 |
| WO | WO 98/01524 | | 1/1998 |

OTHER PUBLICATIONS

Heike Kelkenberg, Marl, *Detergenzien auf Zuckerbasis, Neue Komponenten fuer Waschrohstoffe und Kosmetika*, Tenside Surfactants Detergents 25 (1988) pp 8–13.

U. Ploog, *Kosmetika,Aerosole Riechstoffe*, Seifen–Öle–Fette–Wachse–108.Jg.–Nr. Dec. 1982, pp 373–376.

H.–J. Lehmann, *Die Weiterentwicklung des Tellertests zur Beurteilung von Spuelmitteln*, Fette, Seifen, Anstrichmittel 74, Nr. 3, 1972, pp 163–165.

* cited by examiner

*Primary Examiner*—Charles Boyer
(74) *Attorney, Agent, or Firm*—John E. Drach; Steven J. Trzaska

(57) ABSTRACT

A dishwashing detergent composition containing: (a) an alkoxylated carboxylic acid ester; and (b) a surfactant selected from the group consisting of an anionic surfactant, an amphoteric surfactant, a zwitterionic surfactant, and mixtures thereof.

8 Claims, No Drawings

HAND DISHWASHING LIQUID COMPRISING AN ALKOXYLATED CARBOXYLIC ACID ESTER

BACKGROUND OF THE INVENTION

This invention relates to water-containing manual dishwashing detergents containing alkoxylated carboxylic acid esters, more particularly those which have been produced by reacting carboxylic acid esters and alkylene oxides in the presence of calcined hydrotalcites, and other surfactants and to the use of the alkoxylated carboxylic acid esters as surfactants for the production of manual dishwashing detergents.

"Dirty" dishes are manually cleaned with liquid or concentrated surfactant solutions which are now expected to meet various, in some cases very different requirements. The detergents are expected

- to lend themselves to formulation as concentrates with a high active substance content,
- to be liquid or at least flowable,
- to have a low cold cloud point,
- to be dermatologically safe, i.e. not to irritate the skin, even in concentrated form,
- to develop a vigorous stable foam, even when fats have accumulated in large amounts in the wash liquor and, of course,
- to have a high dishwashing performance.

Even though a large number of products is presently available on the market, there is still a keen interest both on the part of the raw material supplier and the product manufacturers and on the part of the consumer in preparations which satisfy the complex requirements stated above better than known products.

Alkoxylated carboxylic acid esters obtained by homogeneous catalysis in the presence of hydroxides and reducing agents or a co-catalyst are known from DE-A1 19 611 999 and International patent application WO 94/13618. According to both these documents, the esters in question may be used in laundry detergents, dishwashing detergents and cleaners.

In addition, DE-A- 43 26 112 describes low-foaming multipurpose cleaners containing alkoxylated carboxylic acid esters in admixture with alkyl glycosides and optionally other surfactants, such as alkyl sulfates, alkylether sulfates and fatty alcohol polyglycol ethers. These known multipurpose cleaners are intended for the cleaning of hard surfaces, such as clinker bricks, ceramic tiles, enamel, PVC, glass or wood floors. In contrast to manual dishwashing detergents, however, multipurpose cleaners do not have to clean surfaces heavily soiled with fats and proteins. In addition, dermatological compatibility is much more important in the case of manual dishwashing detergents.

Now, the problem addressed by the present invention was to provide manual dishwashing detergents which would meet the stringent requirements of both consumer and manufacturer.

The present invention relates to water-based manual dishwashing detergents containing a. alkoxylated carboxylic acid esters and b. anionic surfactants and/or c. amphoteric or zwitterionic surfactants.

It has surprisingly been found that the detergents according to the invention can be formulated as concentrates with a high active substance content, do not irritate the skin irrespective of their concentration and, at the same time, produce a rich foam which is stable even to high levels of fats and have excellent dishwashing performance. The invention includes the observation that mixtures with alkyl sulfates, alkylether sulfates, monoglyceride sulfates, sulfosuccinates, alkyl glycosides and/or betaines lead to a further improvement in the properties. It has also been found that the manual dishwashing detergents according to the invention may readily be formulated with antibacterial agents.

Alkoxylated Carboxylic Acid Esters

Alkoxylated carboxylic acid esters, which are a compulsory constituent of the detergents according to the invention, are known from the prior art. They may be obtained, for example, by esterification of alkoxylated carboxylic acids with alcohols. For the purposes of the present invention, however, the compounds are produced by reaction of carboxylic acid esters with alkylene oxides using catalysts, more especially calcined hydrotalcite in accordance with DE-A-39 14 131, which give compounds with a narrow homolog distribution. Carboxylic acid esters of both monohydric alcohols and dihydric alcohols can be alkoxylated by this process. Alkoxylated carboxylic acid esters of monohydric alcohols corresponding to general formula (I):

$$R^1\underset{\underset{O}{\|}}{C}(AlkO)_nOR^2 \qquad (I)$$

in which $R^1CO$ is an aliphatic acyl group derived from a carboxylic acid, AlkO stands for alkylene oxide and $R^2$ is an aliphatic alkyl group derived from a monohydric aliphatic alcohol, are preferred for the purposes of the invention. Alkoxylated carboxylic acid esters of formula (I), in which $R^1CO$ is an aliphatic acyl group containing 6 to 22 carbon atoms, AlkO stands for a $CH_2CH_2O$—, $CHCH_3CH_2O$— and/or $CH_2$—$CHCH_3O$ group, n has an average value of 3 to 20 and $R^2$ is an aliphatic alkyl group containing 1 to 22 carbon atoms, are particularly suitable.

Preferred acyl groups are derived from carboxylic acids containing 6 to 22 carbon atoms of natural or synthetic origin, more especially from linear, saturated and/or unsaturated fatty acids, including the technical mixtures thereof obtainable by lipolysis from animal and/or vegetable fats and oils, for example from coconut oil, palm kernel oil, palm oil, soya oil, sunflower oil, rapeseed oil, cottonseed oil, fish oil, bovine tallow and lard. Examples of such carboxylic acids are caproic acid, caprylic acid, 2-ethyl hexanoic acid, capric acid, lauric acid, isotridecanoic acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and/or erucic acid.

Preferred alkyl groups are derived from primary, aliphatic monohydric alcohols containing 1 to 22 carbon atoms which may be saturated and/or unsaturated. Examples of suitable monoalcohols are methanol, ethanol, propanol, butanol, pentanol and the hydrogenation products of the above-mentioned carboxylic acids containing 6 to 22 carbon atoms, more particularly methanol.

AlkO stands for the alkylene oxides which are reacted with the carboxylic acid esters and which comprise ethylene oxide, propylene oxide and/or butylene oxides, preferably ethylene oxide and/or propylene oxide and more particularly ethylene oxide on its own.

Alkoxylated carboxylic acid esters of formula (I), in which AlkO stands for a $CH_2CH_2O$ group, n has an average value of 5 to 15 and $R^2$ is a methyl group, are particularly suitable. Examples of such compounds are lauric acid methyl ester, coconut fatty acid methyl ester and tallow fatty acid methyl ester alkoxylated with, on average, 5, 7, 9 or 11 moles of ethylene oxide.

Anionic Surfactants

Typical examples of anionic surfactants suitable for use as component (b) are soaps, alkyl benzenesulfonates, alkane sulfonates, olefin sulfonates, alkyl ether sulfonates, glycerol ether sulfonates, α-methyl ester sulfonates, sulfofatty acids, alkyl sulfates, alkylether sulfates, glycerol ether sulfates, monoglyceride (ether) sulfates, hydroxy mixed ether sulfates, fatty acid amide (ether) sulfates, mono- and dialkyl sulfosuccinates, mono- and dialkyl sulfosuccinamates, sulfotriglycerides, amide soaps, ether carboxylic acids and salts thereof, fatty acid isethionates, fatty acid sarcosinates, fatty acid taurides, N-acyl amino acids such as, for example, acyl lactylates, acyl tartrates, acyl glutamates and acyl aspartates, alkyl oligoglucoside sulfates, protein fatty acid condensates (more particularly vegetable wheat-based products) and alkyl (ether)phosphates. Where the anionic surfactants contain polyglycol ether chains, they may have a conventional homolog distribution although they preferably have a narrow homolog distribution. Alkyl sulfates, alkyl ether sulfates, alkane sulfonates, monoglyceride sulfates, sulfosuccinates and/or fatty acid polyglycol ester sulfates are preferably used.

Preferred fatty acid polyglycol ester sulfates are compounds which are obtained by sulfation in known manner of fatty acid alkoxylates onto which an average of 1 to 3 moles of alkylene oxide have been added. Fatty acid alkoxylates such as these are obtainable by addition of alkylene oxide, preferably ethylene oxide, onto fatty acids in the presence of bases, such as sodium methylate or triethanolamine or calcined hydrotalcite.

Preferred alkyl sulfates and alkylether sulfates are compounds which contain 12 to 18 carbon atoms in the alkyl moiety and onto which 3 to 15 moles of ethylene oxide have optionally been added. Compounds such as these are commercially available surfactants of which the production is known from the prior art.

Nonionic Surfactants

The manual dishwashing detergents according to the invention may additionally contain nonionic surfactants. Typical examples of additional nonionic surfactants suitable for use as component (c) are fatty alcohol polyglycol ethers, alkyl phenol polyglycol ethers, fatty acid amide polyglycol ethers, fatty amine polyglycol ethers, alkoxylated triglycerides, alk(en)yl oligoglycosides, fatty acid-N-alkyl glucamides, protein hydrolyzates (more particularly wheat-based vegetable products), polyol fatty acid esters, sugar esters, sorbitan esters, polysorbates and amine oxides. Where the nonionic surfactants contain polyglycol ether chains, they may have a conventional homolog distribution although they preferably have a narrow homolog distribution. Fatty alcohol polyglycol ethers, alkyl oligoglucosides, fatty acid-N-alkyl glucamides and/or amine oxides are preferred.

In a preferred embodiment of the invention, the nonionic surfactants used are alkyl and alkenyl oligoglycosides corresponding to formula (II):

$$R^3O—[G]_p \qquad (II)$$

in which $R^3$ is an alkyl and/or alkenyl radical containing 4 to 22 carbon atoms, G is a sugar unit containing 5 or 6 carbon atoms and p is a number of 1 to 10. They may be obtained by the relevant methods of preparative organic chemistry.

The alkyl and/or alkenyl oligoglycosides may be derived from aldoses or ketoses containing 5 or 6 carbon atoms, preferably glucose. Accordingly, the preferred alkyl and/or alkenyl oligoglycosides are alkyl and/or alkenyl oligoglucosides. The index p in general formula (II) indicates the degree of oligomerization (DP), i.e. the distribution of mono- and oligoglycosides, and is a number of 1 to 10. Whereas p in a given compound must always be an integer and, above all, may assume a value of 1 to 6, the value p for a certain alkyl oligoglycoside is an analytically determined calculated quantity which is generally a broken number. Alkyl and/or alkenyl oligoglycosides having an average degree of oligomerization p of 1.1 to 3.0 are preferably used. Alkyl and/or alkenyl oligoglycosides having a degree of oligomerization of less than 1.7 and, more particularly, between 1.2 and 1.4 are preferred from the applicational point of view. The alkyl or alkenyl radical $R^3$ may be derived from primary alcohols containing 4 to 11 and preferably 8 to 10 carbon atoms. Typical examples are butanol, caproic alcohol, caprylic alcohol, capric alcohol and undecyl alcohol and the technical mixtures thereof obtained, for example, in the hydrogenation of technical fatty acid methyl esters or in the hydrogenation of aldehydes from Roelen's oxosynthesis. Alkyl oligoglucosides having a chain length of $C_8$ to $C_{10}$ (DP=1 to 3), which are obtained as first runnings in the separation of technical $C_{8-18}$ coconut fatty alcohol by distillation and which may contain less than 6% by weight of $C_{12}$ alcohol as an impurity, and also alkyl oligoglucosides based on technical $C_{9/11}$ oxoalcohols (DP=1 to 3) are preferred. In addition, the alkyl or alkenyl radical $R^3$ may also be derived from primary alcohols containing 12 to 22 and preferably 12 to 14 carbon atoms. Typical examples are lauryl alcohol, myristyl alcohol, cetyl alcohol, palmitoleyl alcohol, stearyl alcohol, isostearyl alcohol, oleyl alcohol, elaidyl alcohol, petroselinyl alcohol, arachyl alcohol, gadoleyl alcohol, behenyl alcohol, erucyl alcohol, brassidyl alcohol and technical mixtures thereof which may be obtained as described above. Alkyl oligoglucosides based on hydrogenated $C_{12/14}$ coconut fatty alcohol with a DP of 1 to 3 are preferred.

Another group of preferred nonionic surfactants which may form component (c) are fatty acid-N-alkyl polyhydroxyalkylamides which correspond to formula (III):

$$R^5CO—\overset{\overset{\displaystyle R^4}{|}}{N}—[Z] \qquad (III)$$

where $R^5CO$ is an aliphatic acyl group containing 6 to 22 carbon atoms, $R^4$ is an alkyl or hydroxyalkyl group containing 1 to 4 carbon atoms and [Z] is a linear or branched polyhydroxyalkyl group containing 3 to 12 carbon atoms and 3 to 10 hydroxyl groups. The fatty acid-N-alkyl polyhydroxyalkylamides are known compounds which may normally be obtained by reductive amination of a reducing sugar with an alkylamine or an alkanolamine and subsequent acylation with a fatty acid, a fatty acid alkyl ester or a fatty acid chloride. Processes for their production are described in U.S. Pat. No. 1,985,424, in U.S. Pat. No. 2,016,962 and in U.S. Pat. No. 2,703,798 and in International patent application WO 92/06984. An overview of this subject by H. Kelkenberg can be found in Tens. Surf. Det. 25, 8 (1988).

The fatty acid-N-alkyl polyhydroxyalkylamides are preferably derived from reducing sugars containing 5 or 6 carbon atoms, more particularly from glucose. Accordingly, the preferred fatty acid-N-alkyl polyhydroxy-alkylamides are fatty acid-N-alkyl glucamides which correspond to formula (IV):

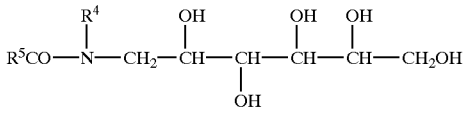

(IV)

Preferred fatty acid-N-alkyl polyhydroxyalkylamides are glucamides corresponding to formula (IV) in which $R^4$ is a methyl group and $R^5CO$ represents the acyl component of caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, arachic acid, gadoleic acid, behenic acid or erucic acid or technical mixtures thereof. Fatty acid-N-alkyl glucamides (IV) obtained by reductive amination of glucose with methylamine and subsequent acylation with lauric acid or $C_{12/14}$ cocofatty acid or a corresponding derivative are particularly preferred. In addition, the polyhydroxyalkylamides may also be derived from maltose and palatinose.

The similarly preferred fatty alcohol polyglycol ethers are in particular addition products of 2 to 10 moles of ethylene oxide onto fatty alcohols containing 12 to 18 carbon atoms, addition products of 2 to 10 moles of ethylene oxide and 1 to 3 moles of propylene oxide and/or butylene oxide onto fatty alcohols containing 12 to 18 carbon atoms and methyl- or butyl-end-capped addition products of 2 to 10 moles of ethylene oxide onto fatty alcohols containing 12 to 18 carbon atoms and addition products of 2 to 10 moles of ethylene oxide and 1 to 3 moles of propylene oxide and/or butylene oxide onto fatty alcohols containing 12 to 18 carbon atoms.

Another preferred group of nonionic surfactants are amine oxides. They are produced from tertiary fatty amines which normally have one long and two short or two long and one short alkyl chain by oxidation in the presence of hydrogen peroxide. The amine oxides suitable for the purposes of the invention correspond to formula (V):

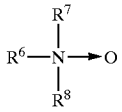

(V)

in which $R^6$ is a linear or branched alkyl group containing 12 to 18 carbon atoms and $R^7$ and $R^8$ independently of one another have the same meaning as $R^6$ or represent an optionally hydroxy-substituted alkyl group containing 1 to 4 carbon atoms. Amine oxides corresponding to formula (V), in which $R^6$ and $R^7$ represent $C_{12/14}$ or $C_{12/18}$ cocoalkyl radicals and $R^8$ is a methyl group or a hydroxyethyl group, are preferably used. Amine oxides corresponding to formula (V), in which $R^6$ is a $C_{12/14}$ or $C_{12/18}$ cocoalkyl group and $R^7$ and $R^8$ represent a methyl or hydroxyethyl group, are also preferred.

Amphoteric or Zwitterionic Surfactants

Typical examples of amphoteric or zwitterionic surfactants suitable for use as component c) are alkyl betaines, alkyl amidobetaines, aminopropionates, imidazolinium betaines and sulfobetaines.

Betaines are known surfactants which are mainly produced by carboxyalkylation, preferably carboxymethylation, of aminic compounds. The starting materials are preferably condensed with halocarboxylic acids or salts thereof, more particularly with sodium chloroacetate, 1 mole of salt being formed per mole of betaine. The addition of unsaturated carboxylic acids, for example acrylic acid, is also possible. Particulars of the nomenclature and, in particular, the distinction between betaines and "genuine" amphoteric surfactants can be found in the article by U. Ploog in Seifen-Öle-Fette-Wachse, 198, 373 (1982). Examples of suitable betaines are the carboxyalkylation products of secondary and, in particular, tertiary amines corresponding to formula (VI):

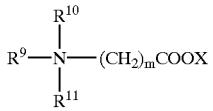

(VI)

in which $R^9$ stands for alkyl and/or alkenyl groups containing 6 to 22 carbon atoms, $R^{10}$ stands for hydrogen or alkyl groups containing 1 to 4 carbon atoms, $R^{11}$ stands for alkyl groups containing 1 to 4 carbon atoms, m is a number of 1 to 6 and X is an alkali metal and/or alkaline earth metal or ammonium. Typical examples are the carboxymethylation products of hexyl methyl amine, hexyl dimethyl amine, octyl dimethyl amine, decyl dimethyl amine, dodecyl methyl amine, dodecyl dimethyl amine, dodecyl ethyl methyl amine, $C_{12/14}$ cocoalkyl dimethyl amine, myristyl dimethyl amine, cetyl dimethyl amine, stearyl dimethyl amine, stearyl ethyl methyl amine, oleyl dimethyl amine, $C_{16/18}$ tallow alkyl dimethyl amine and technical mixtures thereof. Other suitable betaines are carboxyalkylation products of amidoamines (so-called glycinates) corresponding to formula (VII):

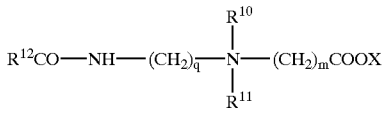

(VII)

in which $R^{12}CO$ is an aliphatic acyl group containing 6 to 22 carbon atoms and 0 or 1 to 3 double bonds, q is a number of 1 to 3 and $R^{10}$, $R^{11}$, m and X are as defined above for formula (VI). Typical examples are reaction products of fatty acids containing 6 to 22 carbon atoms, namely caproic acid, caprylic acid, capric acid, lauric acid, myristic acid, palmitic acid, palmitoleic acid, stearic acid, isostearic acid, oleic acid, elaidic acid, petroselic acid, linoleic acid, linolenic acid, elaeostearic acid, arachic acid, gadoleic acid, behenic acid and erucic acid and technical mixtures thereof, with N,N-dimethyl aminoethyl amine, N,N-dimethyl aminopropyl amine, N,N-diethyl aminoethyl amine and N,N-diethyl aminopropyl amine which are condensed with sodium chloroacetate. It is preferred to use a condensation product of $C_{8/18}$ cocofatty acid-N,N-dimethyl aminopropyl amide with sodium chloroacetate. Other suitable starting materials for the betaines to be used in accordance with the invention are imidazolines corresponding to formula (VIII):

(VIII)

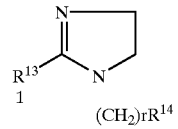

in which $R^{13}$ is an alkyl group containing 5 to21 carbon atoms, $R^{14}$ is a hydroxyl group, an $OCOR^{13}$ or $NHCOR^{13}$ group and r=2 or 3. Imidazolines are also known compounds which may be obtained, for example, by cyclizing condensation of 1 or 2 moles of fatty acid with polyfunctional amines, for example aminoethyl ethanolamine (AEEA) or diethylene triamine. The corresponding carboxyalkylation products are mixtures of different open-chain betaines. Typical examples are condensation products of the above-mentioned fatty acids with AEEA, preferably imidazolines based on lauric acid or—again—$C_{12/14}$ cocofatty acid which are subsequently betainized with sodium chloroacetate.

The manual dishwashing detergents according to the invention contain as compulsory constituents the alkoxylated carboxylic acid esters (component a) and one other surfactant from the described group of anionic surfactants (component b) and amphoteric or zwitterionic surfactants (component c), preferably in a ratio by weight of (a) to (b) or (a) to (c) of 90:10 to 10:90, preferably 75:25 to 25:75 and more preferably 60:40 to 40:60. Particularly suitable dishwashing detergents are those which contain 1 to 30% by weight of ethoxylated carboxylic acid methyl esters, 3 to 35% by weight of anionic surfactants, preferably alkyl sulfates, alkylether sulfates, alkanesulfonates, mono-glyceride sulfates, sulfosuccinates and fatty acid polyglycol ester sulfates, 0 to 25% by weight of nonionic surfactants, preferably fatty alcohol polyglycol ethers, alkyl oligoglycosides and/or amine oxides and 0 to 10% by weight of alkyl betaines and/or alkyl amidobetaines.

High-performance manual dishwashing detergents particularly kind to the skin are obtained if, besides 5 to 20% by weight of ethyoxylated carboxylic acid methyl esters, nonionic surfactants, preferably alkyl glycosides or fatty alcohol polyglycol ethers, are present in quantities of 3 to 25% by weight or alkyl betaines and/or alkyl amidobetaines are additionally present in quantities of 1 to 10% by weight. The percentages by weight are based on the manual dishwashing detergent.

The water-based manual dishwashing detergents may optionally contain typical auxiliaries, such as builders, for example glutaric acid, succinic acid, adipic acid, tartaric acid, gluconic acid, trisodium citrate; solvents, for example acetone or ethanol; hydrotropes, for example cumenesulfonate, butyl glucoside, butylene glycol; viscosity adjusters; pH controllers, for example citric acid; dyes and perfumes, opacifiers and antimicrobial agents and—as the balance to 100% by weight—water.

If antimicrobial manual dishwashing detergents are required, it is recommended to add quaternized ammonium compounds, quaternary fatty acid triethanolamine ester salts (esterquats) and/or aromatic alcohols.

Suitable aromatic alcohols are special phenol derivatives which are described in International patent application WO-A-98/01524 and which are commercially available under the name of Triclosan®. Suitable quaternized ammonium compounds are quaternary alkylamines containing 6 to 22 carbon atoms in the alkyl moiety which have been known for some time as so-called QUATS. Suitable esterquats are compounds corresponding to the following formula:

(IX)

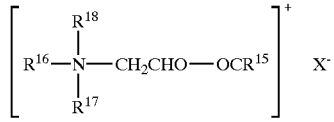

in which $R^{15}CO$ is an acyl group containing 2 to 16 carbon atoms, $R^{16}$ and $R^{17}$ independently of one another represent an alkyl group containing 1 to 16 carbon atoms or a group with the formula $CH_2$—$CH_2$—O—$R^{19}$, $R^{18}$ is an alkyl group containing 1 to 4 carbon atoms, $R^{19}$ is hydrogen and/or $R^{15}CO$ and $X^-$ is an anion.

They are generally prepared by esterification of the alkanolamines with carboxylic acids in the presence of hypophosphorous acid as catalyst, passing air through the reaction mixture and then quaternizing the esterification product. U.S. Pat. No. 3,915,867, U.S. Pat. No. 4,370,272, EP-A-0 239 910, EP-A-0 293 955, EP-A-0 295 739 and EP-A-0 309 052 are cited here are representative of the abundant prior art available on the subject.

The quaternized carboxylic acid alkanolamine ester salts are prepared by methods known per se, alkanolamines corresponding to formula (X):

(X)

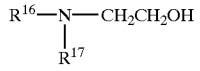

in which $R^{16}$ and $R^{17}$ are as defined for formula (IX), with the proviso that, where $R^{16}$ and/or $R^{17}$ represent(s) the group $CH_2CH_2OR^{19}$, $R^{19}$ is hydrogen, being esterified with carboxylic acids corresponding to the formula $R^{15}COOH$. Suitable alkanolamines are dialkyl ethanolamines ($R^{16}$, $R^{17}$=alkyl group containing 1 to 16 carbon atoms), such as dimethyl ethanolamine, methylethyl ethanolamine, diethyl ethanolamine, methylbutyl ethanolamine and/or methylhexyl ethanolamine, monoalkyl diethanolamines ($R^{16}$=$CH_2CH_2OH$; $R^{17}$=$C_{1-16}$ alkyl group), such as methyl diethanolamine, ethyl diethanolamine and/or butyl diethanolamine, and/or triethanolamines ($R^{16}$, $R^{17}$=$CH_2CH_2OH$). Monoalkyl diethanolamines and/or triethanolamines are preferably used.

Suitable carboxylic acids $R^{15}COOH$ are aliphatic saturated carboxylic acids, such as acetic acid, propionic acid, butyric acid, caproic acid, caprylic acid, capric acid, pelargonic acid, lauric acid, myristic acid, palmitic acid and the technical mixtures thereof obtained, for example, in the pressure hydrolysis of natural fats and oils. Aliphatic saturated carboxylic acids containing 8 to 12 carbon atoms are preferred so that $R^{15}CO$ in formula (I) is preferably an aliphatic saturated acyl group containing 8 to 12 carbon atoms.

The quantity ratio of carboxylic acids to the alkanolamines is determined by the required degree of esterification of the free hydroxyl groups of the alkanolamines. In the case of the preferred monoalkyl diethanolamines and triethanolamines, all or only some of the free hydroxyl groups can be esterified with the carboxylic acids. If the hydroxyl group is not esterified, $R^{19}$ in general formula (IX)

stands for a hydrogen atom. If the hydroxyl group is esterified, $R^{19}$ in general formula (IX) stands for $R^{15}CO$. Where esterification is partial, the average degree of esterification of the—overall—free hydroxyl groups in the case of the mono-diethanolamines is preferably in the range from 1.2 to 1.7 and, in the case of the triethanolamines, is preferably in the range from 1.5 to 1.9, i.e. mixtures of mono-, di- and optionally triesters of the di- or triethanolamines with carboxylic acids are present. According to the invention, all the free hydroxyl groups of the alkanolamines are esterified with carboxylic acids.

The subsequent quaternization is carried out by the methods known in this field and leads to the quaternized carboxylic acid alkanolamine ester salts corresponding to general formula (IX). Compounds with the formula $R^{18}X$, where $R^{18}$ is as defined for formula (IX) and preferably stands for a methyl group, are used for the quaternization. X in general formula (I) stands for an anion preferably selected from the group consisting of methosulfate, ethosulfate, formate, acetate, tartrate, dicarboxylate, citrate, halide, sulfate and nitrate.

According to the invention, it is particularly preferred to use compounds of formula (IX), in which $R^{16}$ is a group $CH_2CH_2O—OCR^{15}$ and $R^{17}$ is a methyl group and/or in which $R^{16}$ and $R^{17}$ stand for a group $CH_2CH_2O—OCR^{15}$ where $R^{15}$ is as previously defined, as antimicrobial agents. Examples of particularly suitable compounds are dimethyl diethanolammonium dicaprylic acid ester methosulfate, methyl triethanolammonium tricaprylic acid ester methosulfate and dimethyl diethanolammonium dipelargonic acid ester methosulfate.

The microbicidal agents may advantageously be used in quantities of 0.1 to 5% by weight, based on the manual dishwashing detergent.

The manual dishwashing detergents according to the invention may be formulated as required in liquid form or as concentrates. They may even be formulated as gels. In this case, it is recommended to use alkoxylated carboxylic acid esters containing at least 8 moles alkylene oxide, more particularly ethylene oxide, on average and at least 12 carbon atoms in the carboxylic acid component.

EXAMPLES

1. Ethoxylated Fatty Acid Methyl Esters Used

The following ethoxylated fatty acid methyl esters were prepared using calcined hydrotalcite as described in DE-A-39 14 131, the number of moles of ethylene oxide (EO) added on representing mean values:

A) $C_{12/14}$ fatty aid+7 EO methyl ester (ratio by weight 70% by weight $C_{12}$ to 30% by weight $C_{14}$)

B) $C_{12/14}$ fatty acid+9 EO methyl ester (ratio by weight 70% by weight $C_{12}$ to 30% by weight $C_{14}$)

C) $C_{10}$ fatty acid+9 EO methyl ester

D) $C_{10}$ fatty acid+12 EO methyl ester

E) $C_{6-10}$ fatty acid+9 EO methyl ester

2. Performance Tests

Foaming behavior was determined by the Wagner method using 0.5% by weight surfactant solutions at 45° C. in the presence of dispersed olive oil. The results are expressed as basic foam (without addition of oil) and foam height after addition of 5 ml oil/l. Dishwashing performance was determined by the plate test [Fette, Seifen, Anstrichmitt., 74, 163 (1972)]. In this test, 14 cm diameter plates were each soiled with 2 $cm^3$ of Stiwa (soil of the "Stiftung Warentest"; standard soil) and stored for 24 h at room temperature. The plates were then washed with 5 l of tap water (hardness 16°d) at 45° C. The manual dishwashing detergents were used in a dose of 0.8 g active substance/l. The dishwashing test was terminated when the foam had completely disappeared. Formulations 1 to 3 correspond to the invention while formulations C1, C2 and C3 are intended for comparison. The results are set out in Table 1.

TABLE 1

Properties of the manual dishwashing detergents (quantities in % by weight, based on active substance)

| | 1 | 2 | 3 | C1 | C2 | C3 |
|---|---|---|---|---|---|---|
| Fatty acid methyl ester A) | — | — | — | — | — | — |
| Fatty acid methyl ester B) | — | — | — | — | — | — |
| Fatty acid methyl ester C) | 18.5 | — | — | — | — | — |
| Fatty acid methyl ester D) | — | 18.5 | — | — | — | — |
| Fatty acid methyl ester E) | — | — | 18.5 | — | — | — |
| Lauryl sulfate sodium salt | 5 | 5 | 5 | — | 5 | 5 |
| Secondary $C_{14-17}$ alkanesulfonate sodium salt | — | — | — | 24 | — | — |
| $C_{12/14}$ lauryl alcohol + 2EO sulfate sodium salt | — | — | — | 5 | — | — |
| $C_{11}$ oxoalcohol + 11EO | — | — | — | — | — | 18.5 |
| Dimethyl-N-cocoalkyl ammonium betaine | 5.8 | 5.8 | 5.8 | — | 5.8 | 5.8 |
| Urea | 2 | 2 | 2 | — | 2 | 2 |
| Sodium formate | 1 | 1 | 1 | — | 1 | 1 |
| Water to 100 | | | | | | |
| Basic foam [ml] | 50 | 50 | 50 | 60 | 35 | 60 |
| Foam height after addition of 5 ml oil (ml) | 25 | 20 | 20 | 30 | 15 | 40 |
| Number of clean plates | 21 | 21 | 22 | 22 | 14 | 20 |

What is claimed is:

1. A dishwashing detergent composition comprising:

(a) an alkoxylated carboxylic acid ester corresponding to formula I:

$$R^1CO(AlkO)_nOR^2 \quad (1)$$

wherein $R^1CO$ is an aliphatic acyl group containing from 6 to 22 carbon atoms, AlkO represents a $CH_2CH_2O—$ group, a $CHCH_3CH_2O—$ group, a $CH_2CHCH_30$ group, n is a number from 3 to 20, and $R^2$ is an aliphatic alkyl group having from 1 to 22 carbon atoms; and (b) from about 3 to 35% by weight of an anionic surfactant;

(c) optionally, a co-surfactant selected from the group consisting of an amphoteric surfactant, a zwitterionic surfactant, and mixtures thereof; and (d) an antibacterial agent selected from the group consisting of a quaternized ammonium compound, a quaternized fatty acid triethanolamine ester salt, an aromatic alcohol, and mixtures thereof.

2. The composition of claim 1 wherein the alkoxylated carboxylic acid ester is derived from a carboxylic acid ester reacted with an alkylene oxide in the presence of a calcined hydrotalcite.

3. The composition of claim 1 wherein in formula I AlkO is a $CH_2CH_2O—$ group, n is a number from 5 to 15, and $R^2$ is a methyl group.

4. The composition of claim 1 wherein the alkoxylated carboxylic acid ester is present in the composition in an amount of from 1 to 30% by weight, based on the weight of the composition.

5. The composition of claim 1 wherein the surfactant is present in the composition in an amount of from 3 to 35% by weight, based on the weight of the composition.

6. The composition of claim 1 wherein (a) and (b) are present in the composition in a ratio by weight of from 90:10 to 10:90.

7. The composition of claim 1 further comprising a nonionic surfactant, other than the alkoxylated carboxylic acid ester of formula I.

8. The composition of claim 7 wherein the nonionic surfactant is selected from the group consisting of fatty alcohol polyglycol ethers, alkyl/alkylene oligoglycosides, amine oxides, fatty acid-N-alkyl polyhydroxyalkyl amides, and mixtures thereof.

* * * * *